United States Patent [19]

Tanner

[11] Patent Number: 4,505,316

[45] Date of Patent: Mar. 19, 1985

[54] PROCESS AND APPARATUS FOR PACKING GRANULAR FOUNDRY MATERIALS

[75] Inventor: Hans Tanner, Schaffhausen, Switzerland

[73] Assignee: George Fischer Ltd., Schaffhausen, Switzerland

[21] Appl. No.: 399,830

[22] Filed: Jul. 19, 1982

[30] Foreign Application Priority Data

Jul. 20, 1981 [CH] Switzerland ..... 4740/81

[51] Int. Cl.[3] ..... B22C 15/00

[52] U.S. Cl. ..... 164/37; 164/15; 164/20

[58] Field of Search ..... 164/15, 19, 37–38, 164/200–202, 20, 169

[56] References Cited

U.S. PATENT DOCUMENTS

| | | | |
|---|---|---|---|
| 3,143,775 | 8/1964 | Jones | 164/37 |
| 3,170,202 | 2/1965 | Huston | 164/37 |
| 3,659,642 | 5/1972 | Vasilkovsky | 164/37 |
| 4,306,609 | 12/1981 | Fischer | 164/37 |
| 4,415,015 | 11/1983 | Zadera | 164/37 |

FOREIGN PATENT DOCUMENTS

| | | | |
|---|---|---|---|
| 54-37030 | 3/1979 | Japan | 164/38 |
| 55-51657 | 12/1980 | Japan | 164/19 |

*Primary Examiner*—Nicholas P. Godici
*Assistant Examiner*—Richard K. Seidel
*Attorney, Agent, or Firm*—Roylance, Abrams, Berdo & Goodman

[57] ABSTRACT

In a closed system a shock pressure wave of a burning gas is used for packing granular mold material loosely distributed around a model. Before the shock pressure is produced, the pore volume of the upper layer of the granular material exposed to the pressure is reduced. Through the pore volume reduction, the active surface of the granular material is increased, so that the gas pressure acts on an increased working surface and, consequently, greater mold hardness is achieved.

5 Claims, 2 Drawing Figures

PROCESS AND APPARATUS FOR PACKING GRANULAR FOUNDRY MATERIALS

This application relates to a process for packing granular materials, in particular for foundry purposes, in a closed system, using the shock wave of an expanding gas, and to an apparatus for performing the process.

BACKGROUND OF THE INVENTION

A number of processes are already known for producing or packing sand molds for foundry purposes. Such processes include embodiments in which compacting of the granular material is caused by the pressure shock of an exothermic reaction of a gas mixture such as in U.S. Pat. No. 3,170,202. In other processes the shock wave caused by releasing the pressure of a high pressure gas is used for compacting a granular material such as in German patent specification No. 1,097,622.

If this shock pressure acts on a loosely distributed mass of granular material, the material will be accelerated and then compressed by subsequent retardation at the pattern-supporting plate.

However, on the back side of the mold (i.e., the side farthest away from the pattern) the hardness of the granular material is not always as high as required. If, e.g., on the back side of the mold a pouring basin or gate has to be made by milling or a similar process, the hardness on this side must be incrreased substantially without any marked influence on the characteristic nature of the mold hardness.

BRIEF DESCRIPTION OF THE INVENTION

An object of the present invention is to provide a process by which the mold hardness at the rear side of a mold, i.e., the mold side subjected to the shock pressure, is increased without significantly influencing the nature of the vertical mold hardness.

A further object is to provide an apparatus for performing this process.

Briefly described, the invention includes a process for compacting a loosely formed mass of granular material having a predetermined pore volume, particularly foundry mold material, around a pattern in a closed system, comprising the steps of reducing the pore volume of material forming the upper, exposed surface of the uncompacted material relative to the pore volume in lower, adjacent material; and thereafter creating a gas pressure wave in the closed system and directing the pressure wave against the upper, exposed surface of the mass.

In another aspect, the invention includes an improved apparatus for compacting a loosely formed mass of granular material such as foundry mold material around a pattern on a support plate, comprising means for treating an exposed surface of the granular material to reduce the pore volume thereof; and pressure chamber means for providing a pressure wave against the treated surface for compacting the mass.

In order that the manner in which the foregoing and other objects are attained in accordance with the invention can be understood in detail, a particularly advantageous embodiment thereof will be described with reference to the accompanying drawings, which form a part of this specification, and wherein:

FIG. 1 shows a simplified arrangement of a molding apparatus as a closed system, in which the pressure of a shock wave form an exothermic reaction of a mixture of fuel and air is directed toward the exposed surface 2 of a loosely distributed or loosely formed mass of molding material 1 for the packing thereof.

Figure 1:
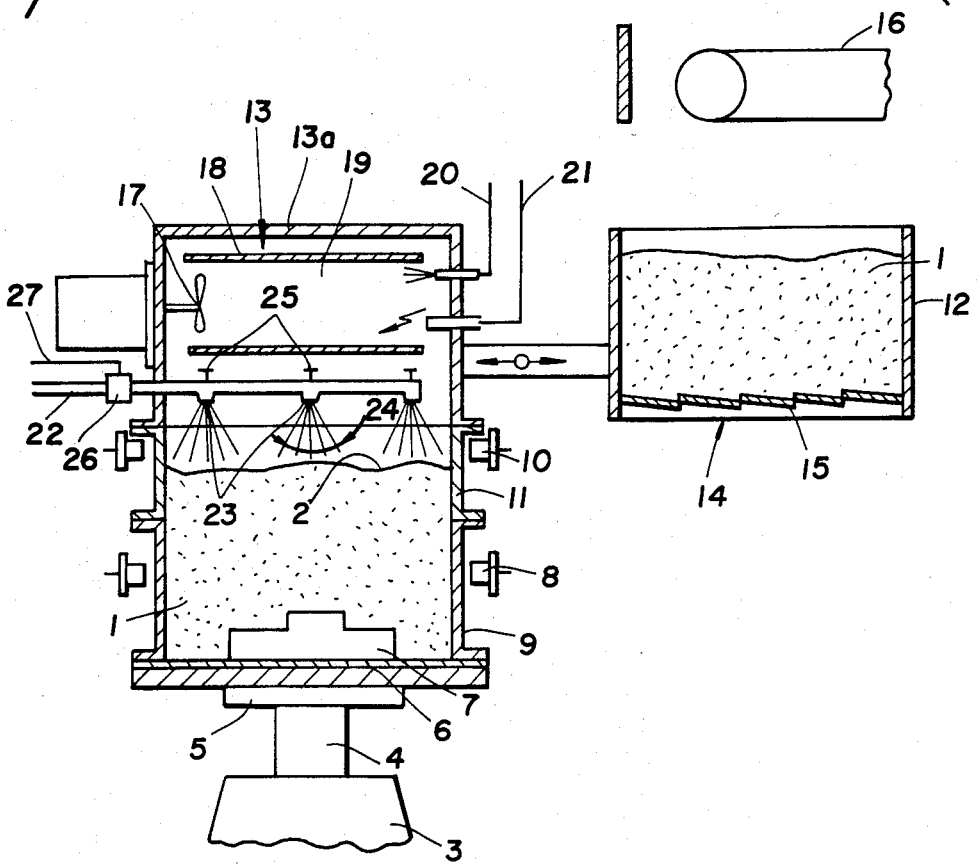
FIG. 1 is a schematic side elevation, in section, of an apparatus in accordance with the present invention with a sprinkler device.

This molding apparatus includes primarily a lifting cylinder 3 with a lifting ram 4, which supports a plate 5. On this plate 5 is a pattern arrangement 6, 7 comprising a pattern plate 6 with a pattern 7. Above this arrangement 6, 7 is a molding box 9 which is movable on rollers 8. Box 9 encloses the arrangement 6, 7 in the predetermined position. A filling frame 11 is positioned above molding box 9 and is centered on the same central axis of symmetry as that of the lifting cylinder 3 and of the arrangement 6, 7. Above the filling frame 11 a dosing container 12 and a pressure chamber 13 are alternately positioned in a cycle, each being, in turn, firmly coupled to form a unit together with the molding box 9 and the model plate 6, so that a closed system results.

The dosing container 12 for the molding material 1 is provided with a bottom closing device 14 which includes swingable covers 15. Above the dosing container 12 is a dosing conveyor belt 16 by which a predetermined amount of molding material 1 is supplied to the container 12 in accordance with the requirements of the molding cycle.

As illustrated, a combustion chamber **13*a* serves as the pressure chamber 13. Chamber 13*a* is hood-shaped and is provided with a motor-operated blower 17 with a conduit tube 18. A pipe 20 for supplying fuel to the chamber extends into space 19 in chamber 13*a***.

The fuel is mixed with air by means of the blower 17 in the combustion chamber **13*a*** in the closed system, so that an exothermic reaction produces a shock pressure wave.

A pipe 22 for supplying liquid to a spray means extends into combustion chamber portion 19 and is provided with at least one jet 23, the spray cone of which is directed against the surface 2 of the molding material. Depending on the size of surface 2, several jets 23 may be used each of which can be provided with means for adjusting the ends of spray cones 24. The jets 23 are so arranged that they produce spray cones which cover the entire molding material surface 2.

Liquid as well as powdery substances can be used as the spraying medium. If liquid, e.g., water, is being used, the spray preferably reaches the molding material surface 2 as drops or mist, wherein the size of the drops and/or the spray intensity may vary.

If powdery, i.e., fine granular material, is being used as spray medium, the particulate size is chosen substantially lower than that of the molding material with which the molding box is filled. The distribution of the powdery material onto the molding material surface is done by means of air under pressure but can also be carried out by solely mechanical means, such as by scattering.

If it is desired to cover only parts of the molding material surface with the spray, it is possible to close individual jets 23. In this case each jet 23 is provided with a valve 25.

In the supply pipe 22 for the spray is a valve 26 which can be operated by a control device, not shown, over a control line 27.

Figure 2:
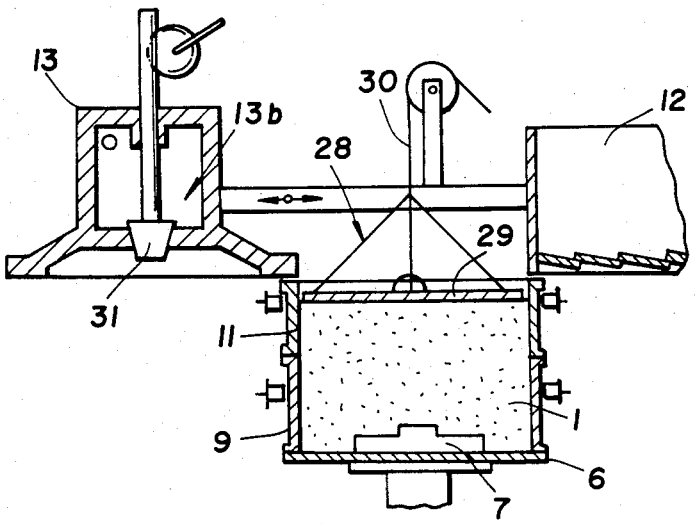
FIG. 2 is an embodiment of the apparatus with pressure means.

FIG. 2 shows an embodiment which differs from the one shown in FIG. 1. Between the pressure chamber 13 and a dosing container 12 there is a pressure device 28 which comprises a pressure plate 29, which is movable up and down, e.g., by means of a tackle. The tackle serves to lower the pressure plate 29 onto the surface 2 of the mold material 1 filled into the mold combination.

The pressure plate 29 has significant weight that alone creates a certain pressure. The surface structure can be modified by varying the weight of the plate or by a rapping movement thereof. Instead of the plate 29 it is also possible to move, e.g., a pressure roll with a selectable pressure over the molding material surface in order to reduce the pore volume. It is also possible to use a pressing element in the form of a wiper for the mold material, in which case a prepared side of the wiper flattens the surface of the mold material in one operation. A homogenizing device can also be used.

The pressure chamber 13 is in this arrangement a reservoir **13*b* for air under high pressure, with a controllable valve 31** inserted for relieving the high pressure. A sudden relief of the air pressure produces a shock pressure wave used for compacting the molding material.

Depending on the circumstances, either the embodiment shown in FIG. 1, the one in FIG. 2 or a combination of both can be used.

By treatment of the molding material surface the individual pores on the surface level are reduced by a portion of their volumes, which means that the distances between the particles and, consequently, the surface is reduced by a certain pore volume.

By reducing the pore volume the active exposed surface of the granules and, consequently, the effective surface of the molding material is increased, so that the surface area against which the shock pressure acts is increased. In that way a higher mold hardness is achieved. Nevertheless, a sufficient pore volume remains so that the air contained in the mold material can escape during the packing.

With the system of the present invention, the mold hardness on the rear side of the mold can be increased substantially and, therefore, optimally meets the requirements of a mold. Specifically, the liquid or particulate matter, or the pressure applied by plate 29, reduces the pore volume by filling the spaces between the molding sand grains, and increasing the surface area against which the shock pressure acts subsequent to application of the pore volume reduction treatment.

By means of a combination of different spray media, it is possible to achieve mold hardness which satisfy very special requirements.

While certain advantageous embodiments have been chosen to illustrate the invention, it will be understood by those skilled in the art that various changes and modifications can be made therein without departing from the scope of the invention as defined in the appended claims.

What is claimed is:

1. A process for compacting granular material, particularly foundry molding sand for forming a casting mold, comprising the steps of:

loosely filling a molding space located between a pattern plate and a molding box with granular material having a predetermined pore volume;

treating by spraying a liquid on selected areas of an upper, exposed surface of the uncompacted granular material to reduce pore volume thereof relative to the predetermined pore volume of lower, adjacent granular material; and thereafter creating a gas pressure wave and directing the gas pressure wave against the treated upper surface of the granular material in a closed system.

2. A process according to claim 1 wherein drops of the liquid are sprayed onto the surface of the granular material.

3. A process according to claim 2 wherein the size of the drops are varied.

4. A process according to claim 1 wherein the liquid is water.

5. A process for compacting granular material, particularly foundry molding sand for forming a casting mold, comprising the steps of:

loosely filling a molding space located between a pattern plate and a molding box with granular material having a predetermined pore volume;

treating by pouring a second material over selected areas of an upper, exposed surface of the uncompacted granular material to reduce pore volume thereof relative to the predetermined pore volume of lower, adjacent granular material, the particle size of the second material being smaller than that of the granular material; and thereafter creating a gas pressure wave and directing the gas pressure wave against the treated upper surface of the granular material in a closed system.

* * * * *